US007310564B2

(12) United States Patent
Leyerer et al.

(10) Patent No.: US 7,310,564 B2
(45) Date of Patent: Dec. 18, 2007

(54) ARRANGEMENT AND METHOD FOR PRODUCING THERAPEUTIC INSOLES

(75) Inventors: Roland Leyerer, Neubeuern (DE); Doug Haas, Havertown, PA (US); Francis Rementilla, Toronto (CA)

(73) Assignee: Vabene GmbH & Co. KG, Neubeuren (DE)

( * ) Notice: Subject to any disclaimer, the term of this patent is extended or adjusted under 35 U.S.C. 154(b) by 203 days.

(21) Appl. No.: 10/719,646

(22) Filed: Nov. 21, 2003

(65) Prior Publication Data

US 2005/0261869 A1 Nov. 24, 2005

(30) Foreign Application Priority Data

Oct. 9, 2003 (DE) ..... 103 46 952

(51) Int. Cl.
*G06F 19/00* (2006.01)
*A43B 13/38* (2006.01)

(52) U.S. Cl. ..... 700/117; 12/146 M; 36/43

(58) Field of Classification Search ..... 700/117, 700/98, 118–119, 163, 182; 702/168, 152, 702/170, 179; 12/142 R, 146 B, 146 M; 36/43, 44

See application file for complete search history.

(56) References Cited

U.S. PATENT DOCUMENTS 5,790,256 A * 8/1998 Brown et al. ..... 356/613
6,904,692 B2 * 6/2005 Tadin ..... 33/515
7,243,446 B2 * 7/2007 Vindriis ..... 36/141
2001/0002232 A1 * 5/2001 Young et al. ..... 409/132
2002/0071597 A1 * 6/2002 Ravitz et al. ..... 382/111
2002/0138923 A1 * 10/2002 Shaffeeullah ..... 12/142 N
2003/0061738 A1 * 4/2003 Grohninger ..... 36/89
2004/0133431 A1 * 7/2004 Udiljak et al. ..... 705/1
2005/0061332 A1 * 3/2005 Greenawalt et al. ..... 128/882

FOREIGN PATENT DOCUMENTS

DE 9400979.1 1/1994
DE 4404695 C2 2/1994
EP 0284922 A2 3/1988
EP 0317591 B1 5/1988

* cited by examiner

*Primary Examiner*—Zoila Cabrera
(74) *Attorney, Agent, or Firm*—Lackenbach Siegel, LLP; Andrew F. Young

(57) ABSTRACT

The present invention relates to an arrangement for producing therapeutic insoles, consisting of a platform with a scanner for scanning the undersides of the patient's feet, a data processing connection for transmitting the scanned image to a computer, a data processing computer program which converts the transmitted data into working instructions for the control of a milling machine, and of said milling machine which mills a therapeutic insole from a blank according to said working instructions, whereby neurological preceptors are placed on the scanner under the patient's foot in accordance with the patient's predisposition, whereby the preceptors are part of a set of standardized preceptors having various dimensions, whereby the preceptors are identified by markings on their underside, and whereby the scanned image contains the identifying markings and the orientation of the preceptors.

12 Claims, 1 Drawing Sheet

ARRANGEMENT AND METHOD FOR PRODUCING THERAPEUTIC INSOLES

CROSS REFERENCE TO RELATED APPLICATIONS

This application claims priority from DE 103 46 952.4, filed Oct. 9, 2003, the entire contents of which are incorporated herein by reference.

BACKGROUND OF THE INVENTION

1. Field of the Invention

The present invention relates to an arrangement and method for producing therapeutic insoles.

2. Description of the Related Art

It is known in prior art to produce orthopedic insoles with the aid of a computer. Thus, EP 0 284 922 A2 suggests that the patient stands on a foot imprint unit consisting of pressure-sensitive measuring elements transmitting pressure to a sensor unit which converts them into digital signals to be processed by a computer. The computer can also have stored additional information, and a shoe insole calculated from both sources can compensate for any existing defect. The data are converted into manufacturing data for a profiling tool.

EP 0 317 591 11 discloses a measuring arrangement for dynamic measuring where the patient walks across the measuring arrangement. In that case, too, the pressure force distribution pattern is digitized and compared by computer with a set value. Control signals for an arrangement for producing insoles are derived from the result.

DE 94 00 979 U shows an assembly for the production of therapeutic insoles which X-rays the foot under stress and at rest and then scans the foot with hydraulic or pneumatic sensor elements. The resulting data are also converted into manufacturing data for insoles.

Finally, DE 44 04 695 C2 discloses a method for acquiring geometric data of a foot by means of measuring soles, a blue-print or a manually produced orthopedic insole. The data are given to a data processor in which a number of measurements of prefabricated blanks are stored. From the data sets, the operator can determine the desired form of the insole and decide which blank is to be used. The data are then converted further into manufacturing signals for a milling machine.

All the above named arrangements and methods proceed from measuring the nature of the foot to produce the appropriate insoles which are made to react passively to certain foot disorders such as flatfoot, splayfoot, clubfoot, pes valgus, pes adductus congenitus, etc.

However, feet are also the subject of other forms of therapy such as acupressure, reflexology, neurological stimulation, etc. Insoles have also been suggested already for those purposes. They were formed such that certain receptors under the feet were stimulated to treat problems of body balance. In contrast to the above mentioned orthopedic insoles, such hand-made or cast insoles have an active, stimulating effect. A special form is the stimulation of the so-called proprioceptors, i.e. the free nerve endings of the muscles whose impulses together with those of the labyrinth (the organ governing balance) provide the brain with the necessary information about body posture.

Accordingly, there is a need for an improved arrangement and method for producing therapeutic insoles overcoming at least one of the detriments noted above.

OBJECTS AND SUMMARY OF THE INVENTION

It is an object of the present invention to create an arrangement and a method for facilitating an automated process from a determination of the suitable form and positioning of stimulators for the proprioceptors in the sole of the foot to the manufacture of insoles derived from these.

The invention relates to an arrangement for producing therapeutic insoles consisting of a platform with a scanner for scanning the undersides of a patient's foot, a data transmission for transmitting the scanned image to a computer, a data processing program which converts the transmitted data to working instructions for controlling a milling machine, and said milling machine which in accordance with the working instructions mills a therapeutic insole from a blank, characterized in that neurological preceptors are arranged in accordance with the patient's predisposition on the scanner under the patent's foot which assumes a predetermined orientation, that the preceptors belong to a set of standardized preceptors of various sizes, that the preceptors are marked, for example on their underside, and that the scanned image contains the markings and the orientation of the preceptors. In this context, preceptors are geometrically defined stimulators which act upon the proprioceptors in the sole of the foot. The marking of the preceptors can take the form of shape and/or size or of imprints, coloration, stickers, embossings, etc.

Thus, the markings and the orientation of the preceptors represent the information the computer needs for the conversion into working instructions for controlling the milling machine.

It should be understood, that in addition to the discussion herein, those skilled in the art will recognize that the present invention enables preceptors to be arranged in a manner that accommodates a patient's predisposition, foot position, or medical condition. In this manner, the present invention enables compensating, and where possible correcting a wide variety of patient concerns. These patient concerns include the treatment of birth defects, extra or missing toes, joint (ankle, knee, hip, and spine) defects or misalignments or injuries, in addition to meeting surgical and rehabilitation needs. Examples of these needs may include the creation of custom insoles to accommodate a patient's missing or weakened toes, bone loss or disease, or the need to stimulate growth and healing through accommodation of selected proprioceptors. The present invention enables automatic accommodation to include the precise selection of amount, degree, slope, and contour of the pressure placed on the proprioceptors and facilities a simple determination and manipulation of the same.

The invention also relates to a method for producing a therapeutic insole consisting of the following steps:

- Preparing a platform with a scanner for the underside of the patient's foot;
- Aligning the patient's foot position in accordance with a predetermined orientation;
- Arranging preceptors marked on the underside under the patient's foot according to a predisposition of the patient;
- Scanning the underside of the patient's foot with the preceptors arranged under the foot;
- Transmitting the scanned image to a computer via at least one of a direct connection, a network connection, and internet connection, a wired connection, a wireless connection, and a removable media connection;

Converting the information of the image by the computer into working instructions for controlling a milling machine, whereby the computer is programmed with computing steps representing the respective markings and the orientation of the preceptors;

Milling the therapeutic insoles from prefabricated blanks in accordance with the working instructions into near-net final and final form; whereby the working instructions are substantially based on the processing of the markings and the orientation of the preceptors and whereby not only the contours of the therapeutic insole, but also the dimensions of the preceptors are milled out.

There is an automatic sequence between the scanning and milling steps. It is not necessary for the operators to intervene in data processing based on the initial scan.

In sum, the present invention relates to an arrangement for producing therapeutic insoles, consisting of a platform with a scanner for scanning the undersides of the patient's feet, a data processing connection for transmitting the scanned image to a computer, a data processing computer program which converts the transmitted data into working instructions for the control of a milling machine, and of said milling machine which mills a therapeutic insole from a blank according to said working instructions, whereby neurological preceptors are placed on the scanner under the patient's foot in accordance with the patient's predisposition, whereby the preceptors are part of a set of standardized preceptors having various dimensions, whereby the preceptors are identified by markings on their underside, and whereby the scanned image contains the identifying markings and the orientation of the preceptors.

The above and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
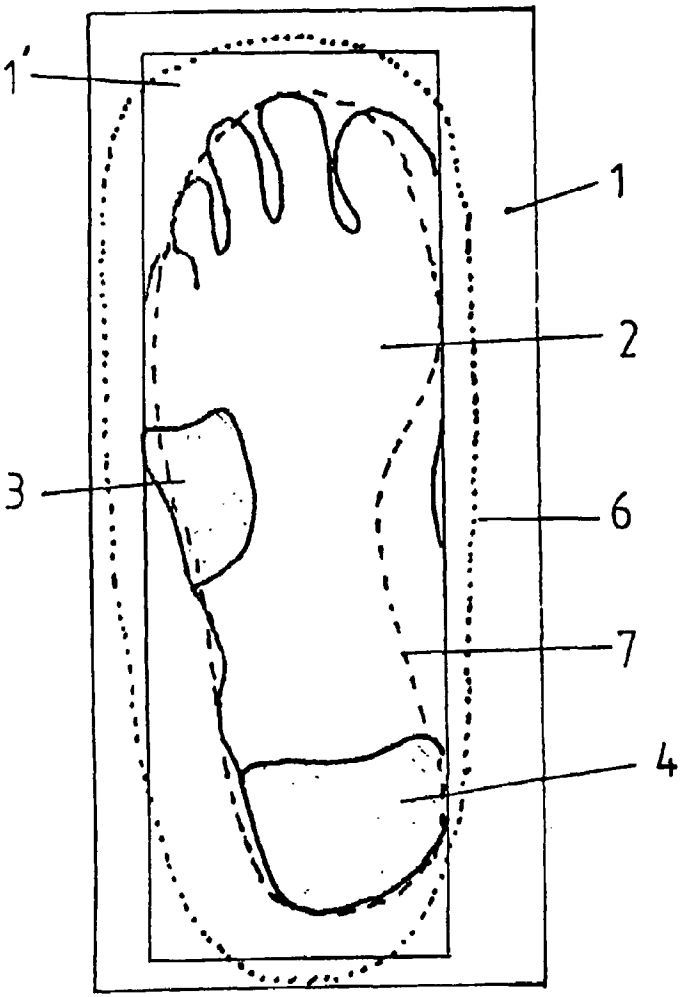
FIG. 1 is a schematic view of a scanned image.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale or shape. For purposes of convenience and clarity only, directional terms, such as top, bottom, up, down, over, above, and below may be used with respect to the drawings. These and similar directional terms should not be construed to limit the scope of the invention in any manner The scanned image of FIG. 1 shows a foot 2 resting on a transparent plate 1' of a 2-D scanner 1. The contour lines 6 and 7 represent a coarser and a closer auxiliary line for covering the current position of the foot and its proportions. Two preceptors 3, 4 are placed under the foot 2. The preceptors consist of a rigid material such as cork or a strong plastic. The preceptors are configured by skilled personnel according to certain predispositions of the patient's body posture.

Then, the foot with the preceptors is scanned, and the image containing information about the proportions of the foot and the type and orientation of the preceptors is converted into data that can be processed by a computer (not shown). The computer urns these data into working instructions for a milling machine (not shown) which follows these instructions to cut the insole 5 (as in FIG. 2) from a blank. No technician has to intervene in the step in which the data of the scanned image are evaluated and converted into working instructions for the milling machine; no corrections are necessary, and no blacks have to be adapted.

Figure 2:
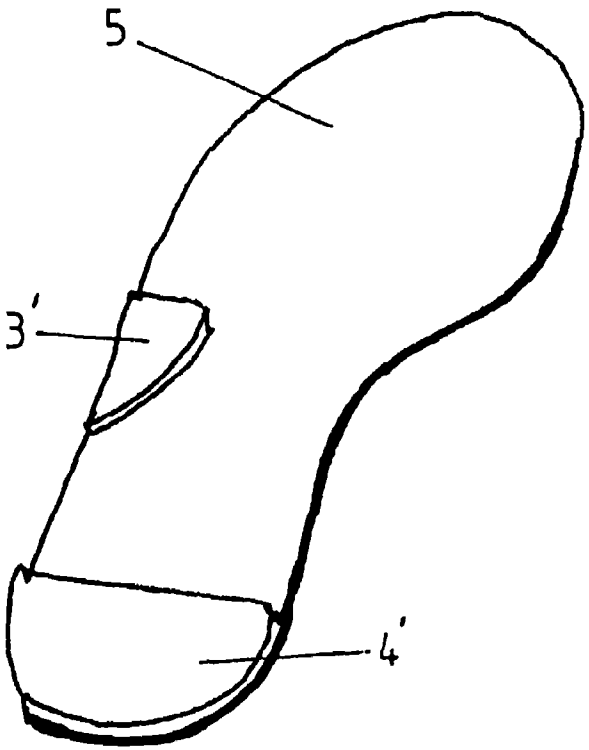
FIG. 2 is a schematic view of the configuration of preceptors on a therapeutic insole.

The view in FIG. 2 shows only the preceptors 3' and 4', which have been cutout by the milling machine. Of course, the finished insole can include other contours such as a foot bed. Preferably, the insole consists of an industrial plastic foam such as E/VA that is covered with a micro fiber material.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A system for producing insoles, comprising:

a platform with a scanner for scanning an underside of a patient's feet;

a data processing connection for transmitting the scanned image to a computer;

a data processing computer program which converts the transmitted data into working instructions for the control of a milling machine;

said milling machine enabling a milling of a therapeutic insole from a blank according to said working instructions;

characterized in that neurological proceptors are placed on the scanner under the patent's foot in accordance with a patient's predisposition;

the proceptors being part of a set of standard proceptors having various dimensions; and the proceptors being identified by markings on their underside, whereby said scanned image contains the identifying markings and the orientation of the preceptors.

2. An arrangement for producing therapeutic insoles, comprising:

a platform for supporting at least one patient's foot;

a scanner for scanning an underside of said patient's foot in said platform and creating a scanned image;

at least one computer containing a data processing computer program;

at least one milling machine;

a data processing connection means for receiving and transmitting said image scanned by said scanner to said computer;

said data processing computer program including means for receiving and converting said transmitted data into a set of working instructions for said milling machine;

said milling machine effective to mill said therapeutic insole from a blank according to said working instructions during a milling operation;

at least one neurological preceptor having a shape selected in accordance with a patient's predisposition;

said proceptor being at least one of a set of standardized proceptors having various dimensions;

said at least one of said set of neurological proceptors on said scanner, positioned between said scanner and said underside of said foot in accordance with said patient's predisposition;

said proceptors being identified by at least one marking on at least their underside surface; and said scanned image containing at least said identifying marking and an orientation of said proceptors, whereby said working instructions reflect said marking and said orientation and enabling said scanned image to be manipulated according to a patient's neurological therapy prior to said transmitting to said milling machine to produce said therapeutic insole from said blank.

3. An arrangement, according to claim 2, wherein:

said markings and said orientation constitute additional computer information;

said additional computer information being transmitted by said data processing connection means and received and converted by said data processing computer program into an additional set of working instructions for said milling machine.

4. An arrangement, according to claim 3, wherein:

said markings identify at least one of a size and a form of said proceptors.

5. An arrangement, according to claim 3, wherein:

said markings consist of at least one of imprints, colorations, stickers, and embossing, whereby said markings are easily identified and reflect proceptor meaning.

6. An arrangement, according to claim 2, wherein:

said markings identify at least one of a size and a form of said proceptors.

7. An arrangement, according to claim 2, wherein:

said markings consist of at least one of imprints, colorations, stickers, and embossing, whereby said markings are easily identified and reflect proceptor meaning.

8. An arrangement, according to claim 2, wherein:

said markings on said preceptors include data referring to at least one of a depth, a slope, a dimension, and a surface texture of at least one of said proceptor and said therapeutic insole, whereby said arrangement enables a processing of said insole into a form maximizing patient comfort at a minimum cost.

9. A method for producing therapeutic insoles, comprising the steps of:

preparing a platform with a scanner for supporting and scanning an underside of a patient's foot;

aligning a patient's foot position in accordance with a predetermined orientation;

selecting proceptors according to a therapeutic predisposition of said patient;

arranging and positioning said selected proceptors under said patient's foot according to said patient's predisposition;

scanning said underside of said patient's foot and capturing an image of at least said foot, said preceptors, markings on said proceptors, and an orientation of said proceptors;

transmitting said scanned image to a designated computer means;

converting and processing said scanned imaged into at least one set of working instructions for controlling a milling machine, whereby said computer means is programmed with computer steps representing at least said markings and said orientation of said proceptors; and milling a therapeutic insole from a selected prefabricated insole blank in accordance with said working instructions; whereby said working instructions are substantially based on a process of scanned markings and an orientation of said proceptors thereby enabling a milling out of both a contour of said therapeutic insole and a dimension of said proceptors.

10. A method, according to claim 9, wherein:

said steps of scanning and milling follow an automatic sequence.

11. A method, according to claim 9, wherein said step of transmitting further comprises the step of:

transmitting said scanned image to said computer means via at least one of a wired and a wireless connection.

12. A method, according to claim 9, wherein:

said markings on said preceptors includes data referring to at least one of a depth, a slope, said dimension, and a surface texture of at least one of said preceptor and said therapeutic insole, whereby said method enables a processing of said insole into a near-net final form.

* * * * *